United States Patent [19]

Gleich et al.

[11] Patent Number: 4,757,917

[45] Date of Patent: Jul. 19, 1988

[54] FLUID STORAGE AND EXPULSION SYSTEM

[75] Inventors: David Gleich, Ringwood, N.J.; Brian W. MacDougall, White Plains, N.Y.

[73] Assignee: Arde, Inc., Norwood, N.J.

[21] Appl. No.: 870,630

[22] Filed: Jun. 4, 1986

[51] Int. Cl.[4] ..... B67D 5/04

[52] U.S. Cl. ..... 222/95; 222/386.5

[58] Field of Search ..... 222/386.5, 94, 95; 137/564.5; 239/323

[56] References Cited

U.S. PATENT DOCUMENTS

| | | | |
|---|---|---|---|
| H80 | 7/1986 | Lewis | 222/386.5 |
| 2,387,598 | 10/1945 | Mercier | 222/95 |
| 3,154,093 | 10/1964 | Blackburn et al. . | |
| 3,213,913 | 10/1965 | Petriello | 222/95 |
| 3,217,649 | 11/1965 | Hagner . | |
| 3,275,193 | 9/1986 | Barr | 222/95 |
| 3,339,803 | 9/1967 | Wayne et al. | 222/95 |
| 3,433,391 | 3/1969 | Krizka et al. . | |
| 3,471,059 | 10/1969 | Moller et al. . | |
| 3,471,349 | 10/1969 | Cohen et al. | 222/386.5 |
| 3,504,827 | 4/1970 | Larson . | |
| 3,592,360 | 7/1971 | Aleck | 222/95 |
| 3,668,868 | 6/1972 | Krzycki . | |
| 3,721,371 | 3/1973 | Dolveck . | |
| 3,828,977 | 8/1974 | Borchert . | |
| 3,880,326 | 4/1975 | Kennard et al. . | |
| 3,931,834 | 1/1976 | Caillet . | |
| 3,945,539 | 3/1976 | Sossong | 222/386.5 |
| 3,981,418 | 9/1976 | Williamson et al. . | |
| 4,062,475 | 12/1977 | Harris et al. . | |
| 4,077,543 | 3/1978 | Kulikowski et al. . | |
| 4,213,545 | 7/1980 | Thompson et al. . | |
| 4,216,881 | 8/1980 | Rosman . | |

*Primary Examiner*—H. Grant Skaggs

*Attorney, Agent, or Firm*—Cohen, Pontani & Lieberman

[57] ABSTRACT

A fluid storage-expulsion system composed of a tank having two poles and being shaped by one or more surfaces of revolution, the tank having a diametral plane and being substantially symmetrical thereabout, a fluid inlet-outlet on one side of the diametral plane, a pressurant inlet on the other side of the diametral plane and a reversible expulsion metallic diaphragm having a pole adjacent the pressurant inlet and conforming substantially to the interior shape of the tank on one side of the diametral plane, the tank being under tension and the diaphragm being under compression, whereby to prevent the diaphragm from uncontrolled buckling and to cause the diaphragm to reverse in an orderly fashion by flexural yielding upon actuation thereof by the pressurant introduced through the pressurant inlet. A method for producing such storage and expulsion system is also disclosed.

30 Claims, 3 Drawing Sheets

FLUID STORAGE AND EXPULSION SYSTEM

BACKGROUND OF THE INVENTION

1. Field Of The Invention

This invention relates to a fluid storage and expulsion system and especially to a fluid storage and expulsion system utilizing a thin reversible metallic diaphragm which progressively collapses from one end of the storage tank to the opposite end in order to force the fluid stored within the tank out of the tank.

This invention relates especially to reusable fluid storage and expulsion systems of the type in which a tank formed by one or more surfaces of revolution contains a reversible metal diaphragm which, upon application of an actuation pressure, is forced to collapse and move from one end of the tank to the other to expel the fluid contained therewithin. Most particularly, this invention relates to such a fluid storage and expulsion system in which the fluid is stored in a stable fashion both when the tank is fully loaded and when the tank is partly empty and in which the diaphragm collapses in an orderly fashion without creating folds or snags on which the diaphragm might break.

2. Description Of The Prior Art

U.S. Pat. No. 3,339,803 granted to Sidney S. Wayne and Benjamin J. Aleck on Sept. 5, 1967 for FLUID STORAGE AND EXPULSION SYSTEM discloses a reversible diaphragm system having meridianal reinforcements distributed along the diaphragm to ensure orderly reversal thereof.

In U.S. Pat. No. 4,216,881 granted to Irwin E. Rosman on Aug. 12, 1980 for PROPELLANT STORAGE EXPULSION SYSTEM, the control of the collapse of a metal diaphragm is effected by the selection of a particular geometric shape, rather than by the use of reinforcements as in the aforementioned Wayne et al U.S. Pat. No. 3,339,803.

In U.S. Pat. No. 3,945,539 granted to Henry J. Sossong on Mar. 23, 1976, a fluid storage and expulsion system is disclosed in which orderly collapse of the flexible or reversible bladder was effected by bonding the bladder to the tank wall with an adhesive that requires a force greater than the force necessary to flex the bladder whereby to ensure a progressive peeling of the bladder from the tank to effect an expulsion of fluid.

Other prior art patents that might have some bearing on the subject matter of this application are:

| Inventor(s) | U.S. Pat. No. | Granted |
|---|---|---|
| Blackburn et al | 3,154,093 | October 27, 1964 |
| Hagner | 3,217,649 | November 16, 1965 |
| Krizka et al | 3,433,391 | March 18, 1969 |
| Moller et al | 3,471,059 | October 7, 1969 |
| Larson | 3,504,827 | April 7, 1970 |
| Krzycki | 3,668,868 | June 13, 1972 |
| Borchert | 3,828,977 | August 13, 1974 |
| Dolveck | 3,721,371 | March 20, 1973 |
| Kennard et al | 3,880,326 | April 29, 1975 |
| Caillet | 3,931,834 | January 13, 1976 |
| Williamson et al | 3,981,418 | September 21, 1976 |
| Harris et al | 4,062,475 | December 13, 1977 |
| Kulikowski et al | 4,077,543 | March 7, 1978 |
| Thomson et al | 4,213,545 | July 22, 1980 |

SUMMARY OF THE INVENTION

The present invention is directed toward the concept of stabilizing a reversible metallic diaphragm in a fluid storage-expulsion system by subjecting said diaphragm in its fully loaded condition to compression while placing the tank in tension. The tank is formed by a surface of revolution and is symmetrical about a diametral plane and the reversible diaphragm conforms substantially to the interior of the tank on one side of the diametral plane, preferably on both sides. The diaphragm is provided with means for effecting a collapse preferentially from the zone of the diametral plane or from the zone of the polar region or apex of the diaphragm, preferably from the polar or apex region.

While the tank may take a wide variety of shapes of surfaces of revolution, the present invention finds particular utility in a toroidal tank which encloses a toroidal reversible diaphragm.

DETAILED DESCRIPTION OF PREFERRED EMBODIMENTS

The Device

Figure 1:
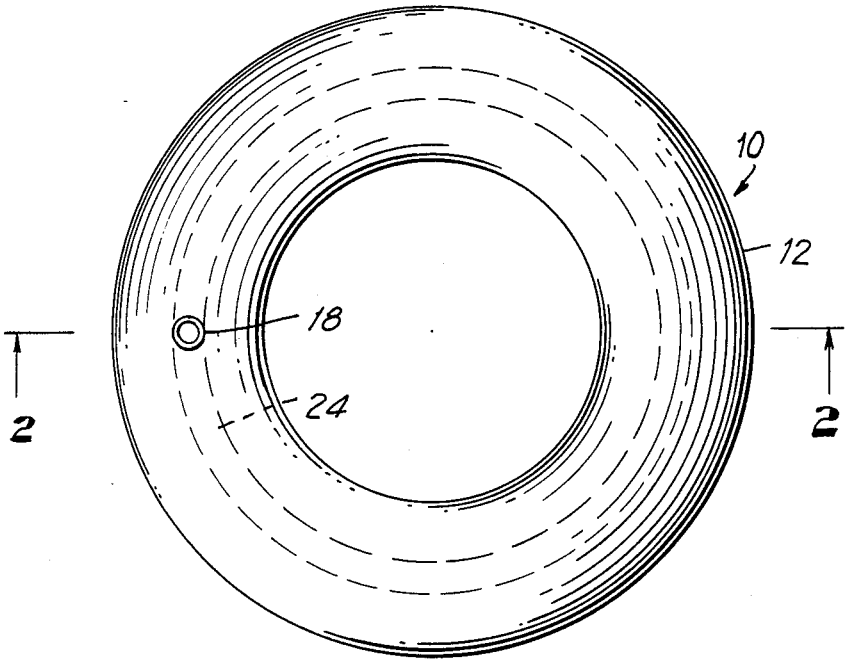
FIG. 1 is a plan view of a fluid storage and expulsion system of toroidal configuration and embodying the present invention.
Figure 2:
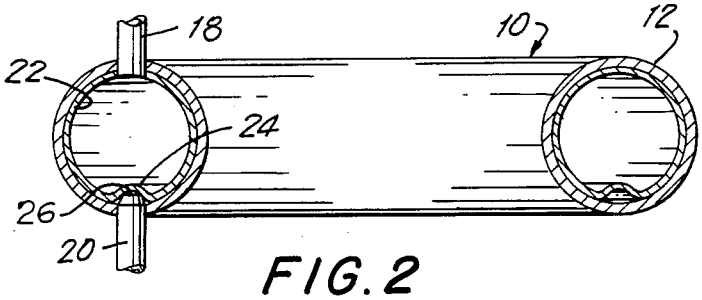
FIG. 2 is a sectional view taken along the line 2—2 of FIG. 1.
Figure 7:
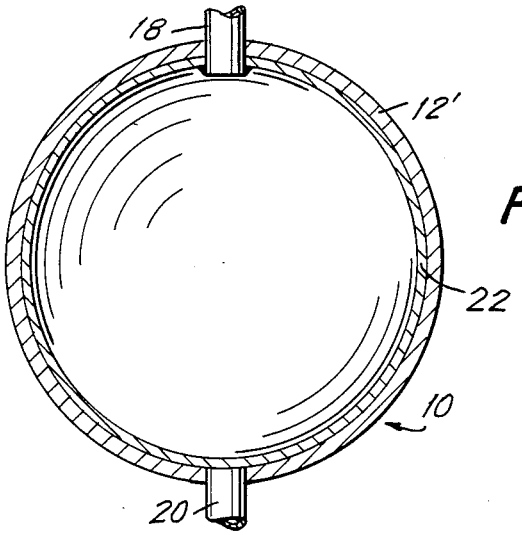
FIG. 7 is a vertical sectional view of a fluid storage and expulsion system utilizing a spherical tank rather than a toroidal tank of FIGS. 1–6.
Figure 8:
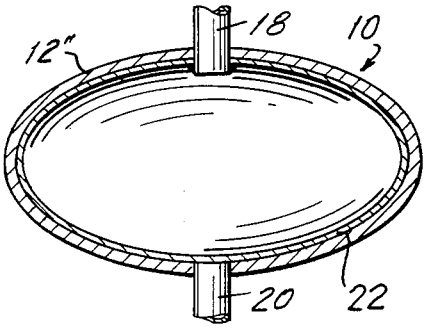
FIG. 8 is a view similar to FIG. 7 illustrating the fluid storage and expulsion system of the present invention utilizing a tank in the form of an oblate spheroid.
Figure 9:
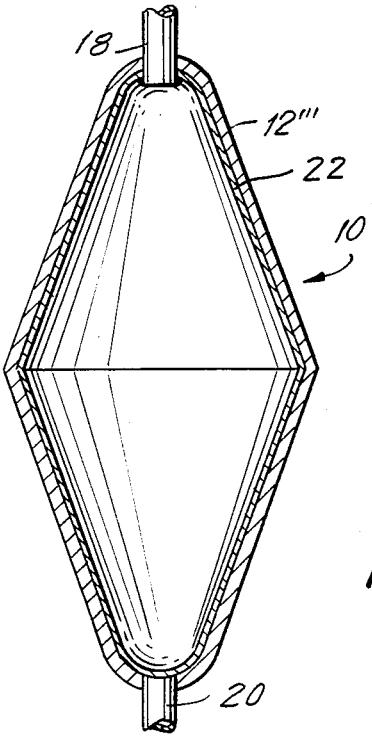
FIG. 9 is a view similar to FIGS. 7 and 8 illustrating the fluid storage and expulsion system of the present invention in connection with a conispheroidal configured tank.

Referring first to FIGS. 1 and 2 in detail, a fluid storage and expulsion system 10 comprises a toroidal tank 12 preferably, although not necessarily, formed of metal, as will be described in greater detail hereinafter. The cross section of the interior of the toroidal tank 12 is shown in FIG. 2 as being circular, although other cross sectional shapes such as ellipses, oblate circles, connicircles, etc. may be employed in such a toroidal tank. Also, as will be discussed in greater detail hereinafter, while the invention does enjoy particular utility when shaped as a torus, other shapes may be employed without departing from this invention (see FIGS. 7, 8 and 9 below).

All of the configurations for which the present invention is suitable are configured in cross section so as to be symmetrical about a diametral plane 14. As will be shown in connection with the description of FIG. 4 below, the cross sectional diametral plane 14 does not have to be aligned with the diametral plane of a toroidal tank 12 as it is shown in FIG. 2. That is to say, the cross sectional diametral plane 14 may be at an angle to the diametral plane 16 of the torus. Tank 12 is provided with a fluid inlet-outlet 18 in the form of a boss that is welded into the tank and a pressurant inlet 20 preferably at the opposite pole of the cross section of the tank from the inlet 18 which is also preferably in the form of a boss welded to the tank 12. As can be seen best in FIG. 2, the pressurant inlet 20 preferably extends inwardly from the exterior of the tank 12 only for the full thickness of the tank and not beyond the interior surface thereof whereas the fluid inlet-outlet 18 in the embodiment shown in FIG. 2 preferably extends inwardly of the tank 12 beyond the interior surface thereof, for reasons which will become apparent hereinafter.

Disposed within the tank 12 is a reversible metal diaphragm 22. In the embodiment shown in FIG. 2, which is presently preferred, the reversible diaphragm 22 substantially conforms to the interior configuration of the tank 12. That is, the diaphragm 22 is in the form of a torus of circular cross section, that is the same as the cross section of the tank 12. Preferably, the diaphragm 22 is secured to the tank as by a weldment surrounding the fluid inlet-outlet 18 in the area in which it projects inwardly of the interior surface of the tank 12.

It is presently preferred that the reversible diaphragm 22 first collapses at the pole or apex and then progressively toward the diametral plane. To achieve this, a means is included for effecting a preferential collapse at the apex in the region of the pressurant inlet 20 and as shown in FIG. 2 this means is an annular dimple 24 in the diaphragm. For reasons that will become apparent hereinafter, fitted within the dimple 24 and overlying the pressurant inlet 20, is an annular surface 26 that is complementary to the dimple 24 and is nested therewithin. Surface 26 is a perforated surface. As used herein, the term "perforated" is intended to include not only a surface 26 having a multiplicity of holes distributed on its surface, but also to a surface having slits or slots adjacent the base or adjacent the apex. Indeed, it is intended to include a surface with any openings that will permit pressurant introduced through the pressurant inlet 20 to be distributed throughout the circumference of the tank and to pass through the surface 26 so as to actuate the reversible diaphragm 22. If desired, the diaphragm may incorporate means to insure a progressive orderly collapse from adjacent the dimple 24 until the collapse reaches the diametral plane 14 of the diaphragm. There are numerous means available for achieving this. Among them is the incorporation on the diaphragm wall of meridianal rings, either integral or separate and brazed, distributed from the pole to the diametral plane in the manner described in the aforementioned U.S. Pat. No. 3,339,803 granted to Sidney S. Wayne et al and assigned to the assignee hereof, or in the control of the cross-sectional thickness of the diaphragm from pole to diametral plane as described in the aforementioned U.S. Pat. No. 4,216,881 granted to Irwin E. Rossman, or the use of elastomeric adhesives. Other means of insuring an orderly collapse from the pole to the diametral plane are known to persons of ordinary skill and may be incorporated in any of the embodiments illustrated herein without departing from this invention.

In accordance with the present invention, by a method to be described hereinafter, the diaphragm 22 as shown in FIG. 2 is in compression whereas the tank 12 surrounding the diaphragm is in tension. The manner in which this condition is achieved will be described hereinafter as will the important advantages flowing from this condition.

With the diaphragm of any of the illustrated embodiments in compression and the tank in tension, it is anticipated that they will provide an effective seal against pressurant migrating between the two components to cause unwanted actuation in a zone or area where diaphragm collapse is not desired. However, if this should pose a problem, that problem is easily solved by utilizing a non-compressive rubber or other elastomeric adhesive between the diaphragm and the tank above the diametral plane in embodiments such as that shown in FIG. 2. Indeed, such a device could be used on both sides of the diametral plane although it is believed that this will not be a necessary expedient in the manufacture of such expulsion system.

It should be noted that as the diaphragm 22 collapses, it is relieved from its compressive stress and in fact, due to the pressure of the pressurant entering through the pressurant inlet 20, is somewhat under tension.

Figure 3:
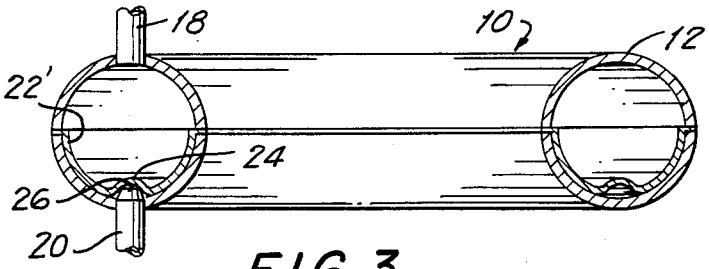
FIG. 3 is a view similar to FIG. 2 but showing a modified embodiment of the invention.

FIG. 3 illustrates a modified form of fluid storage and expulsion system 10 wherein the tank 12 is annular and of circular cross section, as is the tank 12 in FIG. 2. The major difference between the FIG. 3 embodiment and the FIG. 2 embodiment is that the diaphragm 22' in FIG. 3 is not of circular cross section but of semicircular cross section, the diaphragm being secured to the wall of the tank 12 in the zone of the meridianal plane, preferably during fabrication, as will be described hereinafter. Of course, the conneotion of the diaphragm 22' to the tank 12 in the FIG. 3 embodiment must result in a fluid tight connection.

As is also true of the FIG. 2 embodiment, in FIG. 3 the diaphragm 22' has means to ensure a preferential collapse progressing from a preselected zone outwardly therefrom. In FIG. 3, as in FIG. 2, there is a means for preferentially initiating collapse in the area of the pressurant inlet 20, that means being the dimple 24 in the diaphragm 22' which dimple 24 overlies the perforated complementary annular surface 26. This insures that collapse will start at the pole or apex adjacent the pressurant inlet 20 and progress upwardly to the area of the diametral plane whereby to expel the fluid contained within the space defined by the upper portion of the tank 12 and the diaphragm 22'.

Figure 5:
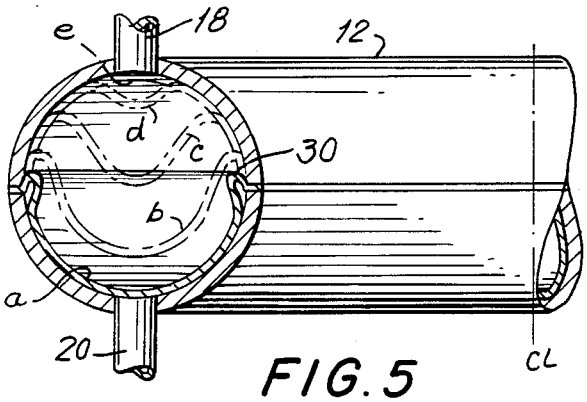
FIG. 5 is a schematic view similar to FIGS. 2 and 3 illustrating the progressive collapse initiated at the cross-section diametral plane and then progressing toward the pole of the diaphragm.

If it is preferred to commence the collapse of the diaphragm 22 or 22' at the diametral plane 14 rather than at the pole adjacent the pressurant inlet 20, then the dimple 24 is omitted from the diaphragm but a short jiggle or loop is provided in the diaphragm in the zone of the diametral plane which loop is designated in FIG. 5 by the reference character 30. Such a loop or jiggle in the diaphragm provides an area in which collapse will preferentially start and when started will progress through the diaphragm from the area first in the diametral plane progressively to the apex of the diaphragm. As is true of the embodiments in which collapse is initiated at the apex and then progressively proceeds to the diametral plane, when it is desired to have the diaphragm initially collapse at the diametral plane and then to have the collapse progress toward the pole or apex of the diaphragm, means may be included in or on the diaphragm to insure such orderly and progressive and controlled collapse. These means, although differently configured, are essentially the same as may be included to insure an orderly collapse from apex to diametral plane, namely rings either brazed or integrally formed in the diaphragm wall, the configuring of the thickness of the diaphragm, the use of elastomeric adhesives or other means known to persons of ordinary skill in this art.

Figure 4:
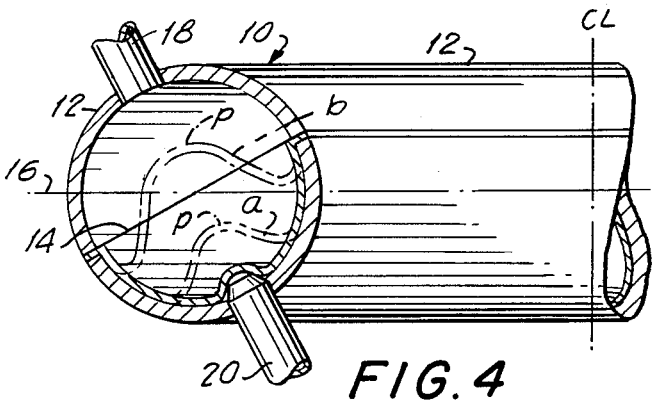
FIG. 4 is a view similar to FIGS. 2 and 3 but schematic and showing a modified placement for the fluid inlet-outlet and the pressurant inlet.

There are numerous modifications which may be effected in the structure of the annular fluid storage and expulsion system 10 of FIGS. 1–3 beyond the modification discussed above in connection with FIG. 5. Thus, for example, the cross sectional configuration of the toroidal tank 12 need not be circular, it could be, if desired, an oblated circle (similar in cross section to the cross section of the oblate spheroid vessel of FIG. 8), it could be connicircular (similar in cross section to the cross section of the connispheroidal tank of FIG. 9), it could be elliptical or any other desired configuration. Additionally, as shown in FIG. 4, the diametral plane of the cross section, that is diametral plane 14, does not necessarily coincide with the diametral plane of the vessel, that is, diametral plane 16, as in FIG. 2. Instead, it may be placed at an angle as seen in FIG. 4 in which case the fluid inlet-outlet 18 and the pressurant inlet 20 are not vertically aligned but are aligned along an axis perpendicular to the diametral plane 14. One reason for this variation is that under certain circumstances, especially where the diameter of the cross section of the tank 12 approaches one-half of the diameter of the entire torus, the fabrication of the tank may be facilitated by the arrangement shown in FIG. 4.

Another reason for tilting the diametral plane of the cross section of a torus to the equitorial plane of the torus, as shown in FIG. 4, is to give further assurance that that portion of the diaphragm which has reversed is in tension.

The dotted lines labeled a and b in FIG. 4 represent two intermediate conditions of the diaphragm 22 as it progressively collapses from the solid line position shown in FIG. 4 to a position of complete collapse wherein the portion originally lying adjacent the pressurant inlet 20 is lying adjacent the fluid inlet-outlet 18. The reason for the reverse portion of the diaphragm to go into tension is that in a torus, as the diaphragm goes through its collapse, any annulus p in the toroidal diaphragm will not only be moving vertically upwardly as the diaphragm goes through its progressive collapse but it will also move horizontally outwardly from the center line CL, whereby to subject such annulus to a tensile stress due to the actual stretching of the diaphragm annulus p. This stretching or straining of course occurs at every point on the diaphragm when it is oriented as shown in FIG. 4.

Uniform reversal of a toroidal diaphragm at all circumferential positions of the toroidal tank is necessary to assure that the tank/propellant center of gravity remains coincident with the tank geometric axis. This type of reversal action can be assured by designing the diaphragm to require a relatively steep increase in actuation pressure required as the diaphragm displacement progresses. This in turn can be accomplished in a variety of ways previously mentioned, including the incorporation of meridianally extending rings or by the selection of an appropriate thickness profile of the diaphragm in cross section or by the use of elastomeric adhesives, etc. With the requirement of a relatively steep increase in actuation pressure as displacement progresses, met by such means, the variations in the diaphragm displacement around the circumference of the toroid can be greatly minimized.

In use, referring first to FIG. 5, if the tank is full of fluid, for example, a liquid fuel or propellant or the like, which has been loaded through the fluid inlet-outlet 18, with the diaphragm 22 under compression and the tank 12 under tension as previously described, the diaphragm is extremely stable within the tank, whereby to reduce instabilities while the tank is full. However, to expel fluid from the tank, pressurant must be supplied through the pressurant inlet 20 whereby to establish a pressure differential across the diaphragm 22 which, when large enough, will cause an orderly collapse in a rolling mode at the bend or jiggle 30, the area which in FIG. 5 is designed to yield first. This will cause the diaphragm to collapse from a position against the tank and labelled a in FIG. 5 to a position spaced from the tank and labelled b in FIG. 5, thereby resulting in the expulsion through fluid inlet-outlet 18 of a volume equivalent to the volume defined by the diaphragm in position a and the diaphragm in position b. Once the diaphragm has moved to position b, it is no longer supported by the wall of the tank 22 and thereby no longer provides lateral stability for the fluid contents of the system. This drawback in the rim rolling or meridianal collapse mode shown in FIG. 5 is overcome by utilizing polar collapse as will be described in connection with FIG. 6 below. Further introduction of an actuating fluid through pressurant inlet 20 will cause an additional collapse of diaphragm 22 to the position c shown in FIG. 5 and then to pcsition d shown in FIG. 5 and finally to a position in which the diaphragm will be up against the interior wall of the tank in the portion of the tank above the meridianal plane 14 rather than below the diametral plane as in the position a of FIG. 5. It will be apparent to those skilled in the art that the mode of collapse is the same irrespective of whether the diaphragm 22 has a circular cross-section as shown in FIG. 2 or is semi-circular and connected at the diametral rim as shown in FIG. 3.

Figure 6:
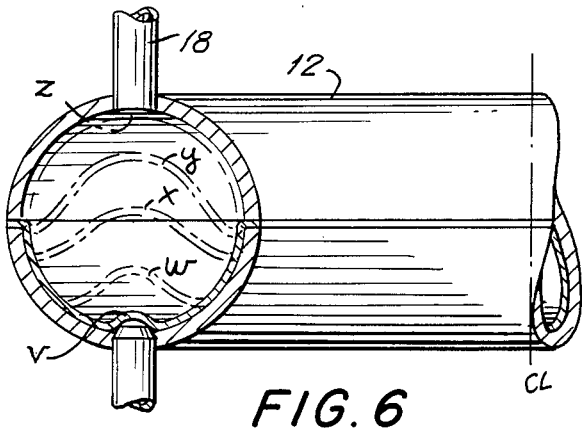
FIG. 6 is a schematic view like FIG. 5 but illustrating the progressive collapse of the diaphragm from the pole to the cross-section diametral plane.

Turning our attention to FIG. 6, which is a diagram similar to FIG. 2 but more schematic, here the mode of operation of a toroidal tank like FIG. 2 is shown with a preferred polar or apex collapse. In FIG. 6, when the tank is fully loaded with a fluid, the diaphragm is shown in the dotted line position identified by the letter character v in which it substantially conforms to the interior of the tank 12, especially below the diametral plane thereof. Upon the application of an adequate actuation pressure from a pressurant entering through the pressurant inlet 20, the diaphragm will commence collapsing in the polar region by virtue of the inclusion of the dimple 24 as previously described. This will cause a collapse from the position identified by the letter v to the position identified by the letter w. It will be seen that in the diaphragm position identified by the letter w, the uncollapsed portion of diaphragm remains in compression and against the interior of the tank 12 whereby to provide stability to the diaphragm and to the fluids contained within the diaphragm during partial expulsion of that fluid. Further expulsion of fluid will cause the diaphragm 22 to reverse from the position shown by the letter w to the position identified by the letter x in FIG. 6 in which position it will be seen that a substantial portion of the diaphragm still remains in compression against the interior wall of the tank 12 and there is little opportunity for the sloshing of fluid which has not yet been expelled through the fluid inlet-outlet 18. It will be understood that as the diaphragm reverses from the condition identified by the letter v to the letter w to the letter x in FIG. 6, that portion of the diaphragm that has gone through reversal is no longer in compression but is in a slight hoop tension stress by virtue of the reversal and the existence of the actuation pressurant below the diaphragm. Thus, it will be understood that as the toroidal diaphragm 22 in FIG. 6 goes through its reversal pole to pole, a highly stable fluid storage and expulsion system is provided, which stability is available not only when the tank is full, as in the FIG. 5 embodiment, but during intermediate conditions of fluid expulsion, that is, in conditions identified by the letters w, x and y in FIG. 6.

It should be understood that while the present system is especially useful when the tank 12 is toroidally configured, other configurations may be employed for the tank which still gain the decided benefits of the invention resulting from the reversible diaphragm being initially in compression with the surrounding tank being in tension. Thus, in FIG. 7, a tank 12' of spherical configuration is shown and in FIG. 8, an oblate spheroid tank 12" is shown and in FIG. 9, a conispheroidal tank 12''' is shown, all of which will have diaphragms which conform at least to the portion of the tank on the side of the diametral plane adjacent the pressurant inlet 20 and preferably conform to the entire interior of the tank. Other configurations which could be employed by way of example are ellipsoids and cylindrical tanks having hemispherical ends. All of these of course are formed by surfaces of revolution and all of these configurations are symmetrical about their diametral planes, in the same way as the toroidal tanks shown in FIGS. 1 through 6. The diaphragms incorporate means for initiating reversal either at the diametral or at the apex or pole and these means may respectively be a jiggle or loop as in FIG. 5 or a dimple. As is true for the toroidal diaphragms illustrated in FIGS. 1 through 6, the collapse of the non-toroidal diaphragms of FIGS. 7, 8 and 9 can be assured to be orderly from apex to diametral plane or from diametral plane to apex, as may be desired by the designer, by using the well known expedients previously mentioned, meridianal rings either integral or affixed as by brazing, the configuring of the cross sectional thickness of the diaphragm, the use of elastomeric adhesives, etc. The manner of operation of such tanks will be obvious to anyone skilled in the art having read this description up to this point, especially in connection with FIGS. 5 and 6.

Method of Manufacture

Preferably, the tank 12 is formed in two halves which, later during assembly, are joined together along the cross sectional diametral plane of the tank. Prior to such joining, however, each tank half is provided with a boss defining a fluid inlet-outlet 18 and a pressurant inlet 20, said bosses being incorporated preferably by welding, assuming the tank halves are formed of metal. Of course, if the tank is formed of non-metallic material, then other methods of incorporating the inlet bosses will have to be employed, as would be known to persons of ordinary skill. The diaphragms are formed by conventional forming techniques such as hydroforming, cryogenic stretch forming or the like, as are well known to persons of ordinary skill. If the diaphragm is to only overlie the one half of the tank, as in the FIG. 3 embodiment, then only the one half diaphragm is so formed and it is preferably provided with a flange for disposition between tank halves prior to welding. If, on the other hand, the diaphragm is to conform to the entire interior surface of the tank 12, as in FIG. 2, then the diaphragm is formed as the tank, in two halves, which are thereafter joined together preferably along the diametral plane to form the entire reversible diaphragm. The joining may be by welding, brazing or the like.

If the diaphragm is designed for a preferential initial collapse along the diametral plane, as in the FIG. 5 embodiment, then the diaphragm will be provided with a jiggle or loop 30 as shown in FIG. 5, said jiggle to be in the area of the diametral plane. However, if the diaphragm is to initiate collapse at the apex or polar region, then during initial formation thereof, the diaphragm is preferably formed with the dimple which, if the diaphragm is to be used in a toroidal expulsion system, will exten circumferentially around the entire diaphragm in the lower apex or polar region as shown in FIGS. 1, 2 and 3. Moreover, if polar initial collapse is preferred, for reasons which will become clear hereinafter, the perforated surface 26 is preferably incorporated into the tank as by welding or the like. Thereafter, if the diaphragm is a full circle in cross-section as shown in FIG. 2, it is fitted into the upper half of the tank 12 and welded around the inlet-outlet port 18 and then the entire assembly is brought into contact with the lower half of the tank 12 which is then joined together preferably by welding. If, on the other hand, the diaphragm is only semicircular in cross-section, then it is placed inside of the lower half of the tank, preferably with a flange extending outwardly over the edge of said lower half, and then the upper half of the tank is placed over the flange and all three are welded together whereby to secure the tank and the diaphragm as illustrated in FIG. 3.

In accordance with the present invention, the tank is made of a material which is relatively thick to give it rigidity and it must have a high yield strain as compared with the diaphragm material. In contrast, the diaphragm is made of a relatively thin metallic material so that it will reverse easily and it is made of a material having a lower yield strain than the material of the tank. When the diaphragm is configured, it may be shaped somewhat under-sized from the interior of the tank, although this is not necessary. After assembly as previously described, the tank and diaphragm are both pressurized by the introduction of a pressurizing fluid through the fluid inlet-outlet 18, whereby to first elastically deform both the diaphragm and the tank 12 until the yield strain point of the diaphragm is encountered at which point further pressurization continues in order to plastically deform the diaphragm while preferably remaining within the elastic range of the tank. At this point, the pressurization may be removed whereby to cause the tank 12 to elastically contract and thereby put the stretched diaphragm 22 under compression which in turn will be equalized by the tank 12 being under tension. It is this technique by which the stability of the system is obtained.

Moreover, the plastic deformation of the diaphragm may give certain strength benefits to the diaphragm which can be desirable.

While it is preferred that during the stretching step the tank remain within the elastic limit, this is not necessary to the invention so long as the yield strain of the diaphragm is lower than the yield strain of the tank. As long as this condition is met, pressurization can proceed even to a point where the tank 12 plastically deforms along with the plastic deformation of the diaphragm, although pressurization should not proceed to such a degree as to burst either the diaphragm or the tank. When pressure is removed and the tank and diaphragm contract, the tank will remain in tension whereas the diaphragm will be placed in compression.

Various pairs of materials may be selected for the diaphragm and tank to yield the relative properties required for successfully practicing this invention. Thus, for example, an annealed 1100-O aluminum diaphragm will work successfully with a high strength wrought aluminum tank shell (aluminum 2219, 6061, and 5456). Another acceptable pair of materials is an annealed 304L CRES stainless steel diaphragm and a high strength cryogenically formed 301 CRES stainless steel tank. Suitable results can be achieved by utilizing a diaphragm made of pure annealed titanium and a tank made of 15-3-3-3 titanium or 6A14V titanium. Other pairs of suitable materials will readily suggest themselves to persons of ordinary skill.

Because of the stretching of the diaphragm during the manufacture thereof, the perforated surface 26 is highly desirable for the purpose of preventing the pressurization step from eliminating the dimple 24. That is to say, by having the surface 26 secured within the tank overlying the pressurant inlet 20, and in nesting relation with the dimple prior to pressurization of the tank-diaphragm in the manufacture thereof, when pressurization occurs, the perforated surface 26 will support the dimple and prevent its being flattened by the high pressure fluid within the diaphragm.

While tanks of the construction hereinbefore described can be of a wide variety of sizes and shapes, a typical toroidal tank currently under development has a center to center dimension of 3.87 inches and a circular diameter of 1.25 inches. In this particular structure, the tank thickness is 0.04 inches and the thickness of the diaphragm is 0.01 inches, the diaphragm being formed of 1100-O aluminum and the tank of high strength wrought aluminum 6061. These values and materials are given only by way of illustration and are not intended in any way to limit the scope of this invention.

While we have described the preferred embodiments of the invention and have suggested various modifications therein, other changes and modifications may be made therein within the scope of the appended claims without departing from the spirit and scope of this invention.

What is claimed is:

1. A fluid storage-expulsion system comprising:

a tank having two poles and being shaped by one or more surfaces of revolution, said tank having a diametral plane and being substantially symmetrical thereabout;

a fluid inlet-outlet means on one side of said diametral plane;

a pressurant inlet means on the other side of said diametral plane; and a reversible expulsion metallic diaphragm having a pole adjacent said pressurant inlet and conforming substantially to the interior shape of said tank on one side of said diametral plane, said diaphragm having a thickness less than that of said tank and a yield strain smaller than that of said tank, and said tank and diaphragm being prestressed so that said tank is under tension and said diaphragm is under compression, whereby to stabilize and prevent said diaphragm from uncontrolled buckling and to cause said diaphragm to reverse in an orderly fashion by flexural yielding upon actuation thereof by pressurant introduced through said pressurant inlet.

2. The fluid storage-expulsion system of claim 1, wherein said tank is comprised of metal.

3. The fluid storage-expulsion system of claim 1, further comprising means for connecting said diaphragm to said tank.

4. The fluid storage-expulsion system of claim 1, wherein said means for connecting said diaphragm to said tank is in the zone of the diametral plane.

5. The fluid storage-expulsion system of claim 1, wherein said means for connecting said diaphragm to said tank surrounds the fluid inlet-outlet means in close proximity thereto.

6. The fluid storage-expulsion system of claim 5, further comprising a layer of elastomeric cement between said tank and said diaphragm on the side of said diametral plane which includes said fluid inlet-outlet.

7. The fluid storage-expulsion system of claim 6, wherein said layer of elastomeric cement is gas impervious and continuous throughout the entire side of said diametral plane.

8. The fluid storage-expulsion system of claim 1, further comprising means for causing said diaphragm to first reverse at the pole thereof adjacent said pressurant inlet and then to progressively reverse from said pole to said diametral plane.

9. The fluid storage-expulsion system of claim 8, wherein said means for causing said diaphragm to first reverse at said pole is an inwardly extending dimple in said diaphragm at said pole.

10. The fluid storage-expulsion system of claim 9, further comprising a perforated member shaped complementary to said dimple secured to the inner wall of said tank in a position to fit inside of said dimple.

11. The fluid storage-expulsion system of claim 1, wherein said tank is toroidally shaped.

12. The fluid storage-expulsion system of claim 11, wherein the diametral plane of the cross section of said toroidal tank is at an angle to the equitorial plane of the toroidal tank and said pressurant inlet and said fluid inlet-outlet are located at the two poles of the cross section of said tank.

13. The fluid storage-expulsion system of claim 1, wherein said pressurant inlet is located at one pole of said tank, and further comprising an annular inwardly extending dimple in said diaphragm in the portion overlying said pressurant inlet for causing said diaphragm to first reverse at said dimple.

14. The fluid storage-expulsion system of claim 13, further comprising means for insuring progressive reversal of said diaphragm from adjacent said dimple to said diametral plane.

15. The fluid storage-expulsion system of claim 1, further comprising means for causing said diaphragm to first reverse at said diametral plane and then to progressively reverse from said diametral plane to said pole.

16. A method of constructing a fluid storage and expulsion system comprising the steps of:

a. fabricating a tank having two poles and being shaped by one or more surfaces of revolution which is symmetrical about a diametral plane, said tank having a predetermined thickness and a yield strain of a given value;

b. providing said tank with a fluid inlet-outlet at one pole of said tank and a pressurant inlet at the other pole of said tank;

c. disposing within said tank a reversible metallic diaphragm conforming substantially to the interior shape of said tank on one side of said diametral plane, said diaphragm having a thickness less than that of said tank and a yield strain smaller than that of said tank, the interior of said diaphragm being in communication with said fluid inlet-outlet;

d. introducing a prestressing fluid into the interior of said tank and disphragm and pressurizing said prestressing fluid to stretch said diaphragm beyond said yield stain point without bursting either said diaphragm or said tank; and e. releasing the pressure on said prestressing fluid whereby said tank contracts elastically to place said diaphragm in compression and said tank in tension and thereby stabilize said diaphragm within said tank.

17. The method of claim 16, wherein said pressurizing of said fluid stretches said diaphragm beyond said yield strain point without stretching said tank beyond its elastic range.

18. The method of claim 17, further comprising the steps of forming a dimple in said diaphragm adjacent the pressurant inlet.

19. The method of claim 18, further comprising forming a perforated supporting surface on said tank interior adjacent said pressurant inlet and complementing said dimple to maintain said dimple shape while said fluid is pressurized.

20. The method of claim 17, wherein said tank is comprised of metal and said reversible diaphragm conforms to the interior shape of said tank on one side of said diametral plane, and further comprising the step of welding said diaphragm to said tank in the zone of said diametral plane.

21. The method of claim 20, further comprising the step of forming a dimple in said diaphragm adjacent the pressurant inlet.

22. The method of claim 21, further comprising forming a perforated supporting surface on said tank interior adjacent said pressurant inlet and complementing said dimple to maintain said dimple shape while said fluid is pressurized.

23. The method of claim 21, wherein said tank is toroidal and said dimple defines an annulus overlying said pressurant inlet.

24. The method of claim 23, further comprising forming an annular perforated supporting surface on said tank interior complimentary to said dimple and overlying said pressurant inlet to maintain said dimple shape while said fluid is pressurized.

25. The method of claim 17, wherein said tank is comprised of metal, and said reversible diaphragm substantially conforms to the entire shape of the interior of said tank, further comprising the step of welding said diaphragm to said tank to define a weldment surrounding said fluid inlet-outlet.

26. The method of claim 25, further comprising the step of forming a dimple in said diaphragm adjacent the pressurant inlet.

27. The method of claim 26, further comprising forming a perforated supporting surface on said tank interior adjacent said pressurant inlet and complementing said dimple to maintain said dimple shape while said fluid is pressurized.

28. The method of claim 26, wherein said tank is toroidal and said dimple defines an annulus overlying said pressurant inlet.

29. The method of claim 28, further comprising forming an annular perforated supporting surface on said tank interior complimentary to said dimple and overlying said pressurant inlet to maintain said dimple shape while said fluid is pressurized.

30. The method of claim 25, further comprising the step of applying a rubber adhesive between said diaphragm and said tank on the side of said diametral plane including said fluid inlet-outlet.

* * * * *